United States Patent [19]

Igarashi

[11] Patent Number: 4,725,798

[45] Date of Patent: Feb. 16, 1988

[54] WAVEGUIDE FILTER

[75] Inventor: Sadao Igarashi, Soma, Japan

[73] Assignee: Alps Electric, Ltd., Japan

[21] Appl. No.: 902,869

[22] Filed: Sep. 2, 1986

[30] Foreign Application Priority Data

Sep. 6, 1985 [JP] Japan ..... 60-198058
Sep. 6, 1985 [JP] Japan ..... 60-137235[U]

[51] Int. Cl.[4] ..... H01P 1/208; H01P 7/06

[52] U.S. Cl. ..... 333/212; 333/208; 333/230; 333/248

[58] Field of Search ..... 333/202, 206, 207, 208–212, 333/222, 223, 248, 235, 238, 239, 231, 219, 227, 230, 252

[56] References Cited

U.S. PATENT DOCUMENTS

| | | | |
|---|---|---|---|
| 2,432,093 | 12/1947 | Fox | 333/209 |
| 3,157,847 | 11/1964 | Williams | 333/248 |
| 3,537,043 | 10/1970 | Smith | 333/239 |
| 3,577,105 | 5/1971 | Jones, Jr. | 333/239 |
| 4,320,367 | 3/1982 | Boujet | 333/209 |
| 4,396,896 | 8/1983 | Williams | 333/212 |

FOREIGN PATENT DOCUMENTS

| | | | |
|---|---|---|---|
| 879853 | 6/1953 | Fed. Rep. of Germany | 333/239 |

OTHER PUBLICATIONS

Beardow–"Waveguide Manufacturing Techniques", British Communications and Electronics, Oct. 1958; pp. 772–778.

*Primary Examiner*—Marvin L. Nussbaum
*Attorney, Agent, or Firm*—Guy W. Shoup

[57] ABSTRACT

A waveguide filter is provided which comprises a plurality of waveguide resonators arranged in series in the longitudinal direction of the filter with each contacting tightly with adjacent ones, each of the waveguide resonators being composed of a rectangular dielectric having a length and a permittivity complying with the center frequency of a bandpass filter, on the periphery of which a metal film is provided except on the portions of induction windows of its two sides mutually opposed in the longitudinal direction. According to another feature, the metal film of each waveguide resonator is provided while keeping free additionally a no-electrode portion of the bottom side of the reactor, a supporting base on which the waveguide resonators are secured has concave portions formed therein so as to confront the respective no-electrode portions, and adjusting members made of dielectric material are provided slidably and retractably into the respective concave portions so as to vary the respective opening areas of the no-electrode portions.

6 Claims, 17 Drawing Figures

WAVEGUIDE FILTER

BACKGROUND OF THE INVENTION

1. Field of the Invention

This invention relates to a waveguide filter adapted for use in communication devices of the microwave and millimeter wave ranges.

2. Description of the Prior Art

In satellite communication, an earth station is very remote from a satellite (in the case of a geostationary satellite) as far as 35,900 Km, so that a radio wave received by a receiver is very weak. Consequently, a filter for handling such a weak radio wave must exhibit only a small transmit transmission loss; thus, a waveguide filter having a high selectivity Q has been used widely as a filter of small loss. Similarly to the receiver side, a waveguide filter of small transit transmission loss has been used frequently on the transmitter side because the transmitter side handles a large power transmission and the energy lost in the course of transit transmission is converted into heat energy to thereby sometimes heat a transmitting apparatus.

In general, as shown in FIG. 7, the waveguide filter is configured so that shunt inductor plates are provided in a waveguide of rectangular in cross section to divide the inside into a plurality of compartments to thereby make each compartment function as a waveguide resonator, whereby a pass band is created. This device is called the shunt inductor type waveguide filter.

In FIG. 7, 41 indicates a waveguide, 42 through 49 indicate shunt inductor plates (hereinafter referred to simply as the inductor plates) which form induction windows, and 50 through 52 indicate waveguide resonators. One waveguide resonator 50 is formed by the inductor plates 42 and 46, inductor plates 43 and 47, and portions of the waveguide 41 extending between the inductor plates 42 and 43 and between the inductor plates 46 and 47; another waveguide resonator 51 if formed by the inductor plates 43, 44, 47, and 48 and the portions therebetween of the waveguide 41; and still another waveguide resonator 52 is formed by the inductor plates 44, 45, 48, and 49 and the portions therebetween of the waveguide 41, thereby resulting in the waveguide filter (a bandpass filter) having three stages consisting of these waveguide resonators 50, 51, and 52. The resonance center frequency and the passband width of the waveguide filter are determined by the dimensions: width and height of the waveguide 41, distance between the inductor plates, and width of the inductor plates 42 through 49 (or size of the induction windows).

The concrete configuration of the conventional waveguide filter will now be described with reference to FIGS. 8 and 9. In FIGS. 8 and 9, the same portion as that shown in FIG. 7 is identified by the same reference numeral with its duplicate explanation omitted.

In FIGS. 8 and 9, 53 through 60 indicate slots formed in the waveguide 41 in which the inductor plates 42 through 49 are to be inserted, 61 and 62 indicate flanges, and 63 through 70 indicate solder for fixing the inductor plates 42 through 49 inserted in the slots 53 through 60 to the waveguide 41. These inductor plates 42 through 49 are secured to the waveguide 41 by forming the slots 53 through 60 of given depth in the waveguide 41 at given intervals, inserting the inductor plates 42 through 49 larger than both the height of the waveguide 41 and the depth of the slots 53 through 60 into these slots 53 through 60, and soldering at spots 63 through 70 from the exterior of the waveguide 41. In the foregoing steps, the metal welding or like process may be adopted as the fixing step other than the soldering process, and other adequate processes may be selected. The flanges 61 and 62 are provided at either end of the waveguide 41 and used for connection with other waveguides and the like.

FIG. 10 is a sectional view taken along line A—A of FIG. 9 wherein 71, 72, and 73 indicate transmission paths of a characteristic impedance Z determined by the dimensions, i.e. the width and height of the waveguide 41, and FIGS. 11 and 12 show the equivalent circuits of the configuration shown in FIG. 10. Specifically, FIG. 11 shows the equivalent circuit under the ideal conditions that the thickness of the inductor plates 42, 43, 46, and 47 is zero. However, because there is really no case where the thickness of the inductor plates 42, 43, 46, and 47 is zero, there results in the equivalent circuit shown in FIG. 12. That is, as shown in FIG. 12, the thicknesses of the inductor plates 42, 43, 46, and 47 correspond in terms of circuitry to respective coils 74 through 77 inserted in series with the transmission path, and these coils 74 through 77 function so as to lower the center frequency of the pass band of the waveguide filter. Therefore, the thickness of the inductor plates, 42 through 49, being used in the waveguide filter must be as thin as possible. Reference numerals 78 and 79 indicate the equivalent elements of the inductor plates 42, 43, 46, and 47.

FIG. 13 is a fragmentary enlarged view of the slots 53 through 60 in which the inductor plates 42 through 49 are inserted. As shown in this drawing, because it is difficult in view of the machining technique to make strictly rectangular the point portion of the inductor plate 42, 46 as well as the bottom portion of the slot 53, 57, the point of the inductor plate 42, 46 would be cut obliquely and/or the bottom of the slot 53, 57 would be rounded in many cases.

FIG. 14 is a sectional view taken along line B—B of FIG. 9 and shows the state wherein the inductor plates 42 and 49 are attached to the waveguide 41. Because the inductor plate 42, 46 is thin, it is impossible to push the inductor plate strongly into the slot 53, 57 of the waveguide 41 and gaps 80 through 82 tend to appear between the point portions of the inductor plates 42 and 46 and the bottom portions of the slots 53 and 57 of the waveguide 41.

FIG. 15 is a sectional view taken along line C—C of FIG. 9 and shows the state wherein the inductor plates 42 through 49 are attached to the waveguide 41, like FIG. 14. Because the width of the slot 57, 58 does not coincide with the thickness of the inductor plate 46, 47, gaps 83 through 85 tend to appear between the inductor plates 46 and 47 and the waveguide 41.

FIG. 16 shows the state wherein the inductor plate 42 is secured to the waveguide 41 through soldering. In many cases, solder would flow into the interior of the waveguide 41 to create a convex portion 86 on the inner surface of the waveguide 41, or solder would flow defectively so as not to reach the inner surface of the waveguide 41 and a concave portion 87 would be created in the inner surface of the waveguide 41.

FIG. 17 is a perspective view of a general adjusting circuit for adjusting the center frequency of the waveguide circuit.

In FIG. 17, 88 indicates a waveguide of rectangular in cross section, having a metal screw 89 positioned at the center in the longitudinal direction and rectractable in the direction orthogonal to the longitudinal direction. 90 indicates a lock nut for fixing the metal screw 89.

According to the conventional waveguide filter of the foregoing configuration, there arise easily the gaps, convex portions, concave portions, etc. owing to the machining technique and the like, and these defects exert influence on the dimensional error and the surface current path of the waveguide filter, thus become the causes of deviation of the center frequency and the passband width of the waveguide filter.

Describing about the dimensional error, for example, in the case of a three-stage waveguide filter having the parameters: the center frequency=12 GHz, the passband width=200 MHz, the width of the waveguide=19.05 mm, its height=9.25 mm, and the longitudinal distance between the inductor plates=16.3−17.0 mm, from an error of 0.1 mm in the longitudinal distance between the inductor plates there results a variation of about 50 MHz in the center frequency, and from an error of 0.1 mm in the dimension of the inductor plate confined inside the waveguide and the width ofthe inductor window there results a change of about 12 MHz in the passband width.

Further, in the case of a three-stage waveguide filter having the parameters: the center frequency=50 GHz, the passband width=200 MHz, the width of the waveguide=4.78 mm, its height=2.39 mm, and the longitudinal distance between the inductor plates=3.6−3.7 mm, from an error of 0.01 mm in the longitudinal distance between the inductor plates there results a variation of about 90 MHz in the center frequency, and from an error of 0.01 mm in the dimension of the inductor plate confined inside the waveguide and in the width of the induction window there results a variation of about 10 MHz in the passband width.

As mentioned above, there was the drawback that even a slight error of dimension causes large variation of the center frequency and the passband width.

Some concrete causes of the above drawbacks are as follows: The point of the inductor plate is inevitably cut obliquely in view of the machining technique as shown in FIG. 13. The bottom of the slot in which the inductor plate is inserted is rounded in view of the machining technique also. Consequently, when the inductor plate is inserted into the slot there appear the gaps between the waveguide and the inductor plate as shown in FIG. 14, and it is impossible to take away these gaps because the inductor plate is thin and can not be pushed strongly at the time of assembly. Owing to these gaps, the dimensions of the inductor plate confined inside the waveguide and the width of the industion window vary and the passband width tends to deviate from a desired value.

Further, because it is impossible to make the thickness of the inductor plate coincide with the width of the slot, the gaps appear as shown in FIG. 15 and these gaps contribute to the occurrence of an error in the longitudinal distance between the inductor plates to thereby cause a deviation in the center frequency. Owing to these gaps, a return loss arises and/or the ripple charcteristic of the pass band becomes worse.

With the formation of convex portions and concave portions through soldering as shown in FIG. 16, the surface current path becomes long due to these convex portions and concave portions and the center frequency deviates from a desired value. In addition, because joining surfaces between the waveguide and the inductor plates are not smooth due to these convex portions and concave portions of solder, the high-frequency resistance of such a surface portion increases and the Q of the circuit lowers, thereby increasing the transmission loss of the pass band.

Further although the deviation of the center frequency will be adjusted by the adjusting circuit shown in FIG. 17, there exists the drawback that the transmission loss is large because of the presence of a convex portion, i.e. the metal screw 89 in the current path.

Furthermore, because the soldering process is carried out to effect fixation and the waveguide is made in the form of a single body, the process of exchanging parts or amending the connected state thereof that should be performed in the case of the presence of dimensional errors or some defects of the inductor plates or the waveguide becomes complicated, and this type of configuration is not suited for mass-production.

SUMMARY OF THE INVENTION

It is an object of the present invention to solve the foregoing drawbacks of the conventional waveguide filter, thus to provide a waveguide filter comprising waveguide resonators each made of a rectangular dielectric on the periphery of which a metal film is provided, whereby its center frequency and passband width can be set precisely and its body can be miniaturized.

It is another object of the present invention to provide a waveguide filter which permits adjustment of the center frequency with involving only a small transmission loss and can be miniaturized.

To achieve the foregoing objects, the present invention provides a waveguide filter comprising a plurality of waveguide resonators arranged in series in the longitudinal direction of the filter with each contacting tightly with adjacent ones, each of the waveguide resonators being composed of a rectangular dielectric having a length and a permittivity complying with the center frequency of a bandpass filter, on the periphery of which a metal film is provided except on the portions of induction windows of its two side mutually opposed in the longitudinal direction.

According to a second feature of the present invention, the metal film of each waveguide resonator is provided while keeping free additionally a no-electrode portion of the bottom side of the resonator, a supporting base on which the waveguide resonators are secured has concave portions formed therein so as to confront the respective non-electrode portions, and adjusting members made of dieletric material are provided slidably and retractably into the respective concave portions so as to vary the respective opening areas of the no-electrode portions.

As will be apparent from the foregoing configuration, each waveguide resonator is composed of a rectangular dielectric having a length and a permittivity complying with the center frequency, on the periphery of which the metal film is provided, and a plurality of these waveguide resonators are arranged in series so as to compose the waveguide filter; thus, the dimensions in the longitudinal direction of the waveguide resonator can be made accurate, the dimensions of the induction window can be made accurate by fabricating it by a thin metal film, and the center frequency and the passband width can be set to prescribed values, whereby there can be provided a novel waveguide filter requiring substantially no adjustment work. Further, because the radio wave travels through the dielectric, the present waveguide filter can be miniaturized, as compared with the conventional device wherein the radio wave travels through the air.

In addition, the no-electrode portion is provided on the bottom side of each waveguide resonator, the concave portions are formed in the supporting base securing the waveguide resonators thereto so as to confront the respective no-electrode portions, and the adjusting members made of dielectric material are provided retractably in the respective concave portions; thus, the permittivity of the path of the radio wave travelling through each no-electrode portion can be adjusted by changing the position of each adjusting member, and the center frequency can be adjusted with involving only a small loss. More, because the radio wave travels through the dielectric, the present waveguide filter can be miniaturized, as compared with the conventional device wherein the radio wave travels through the air.

DESCRIPTION OF THE PREFERRED EMBODIMENTS

Figure 1:
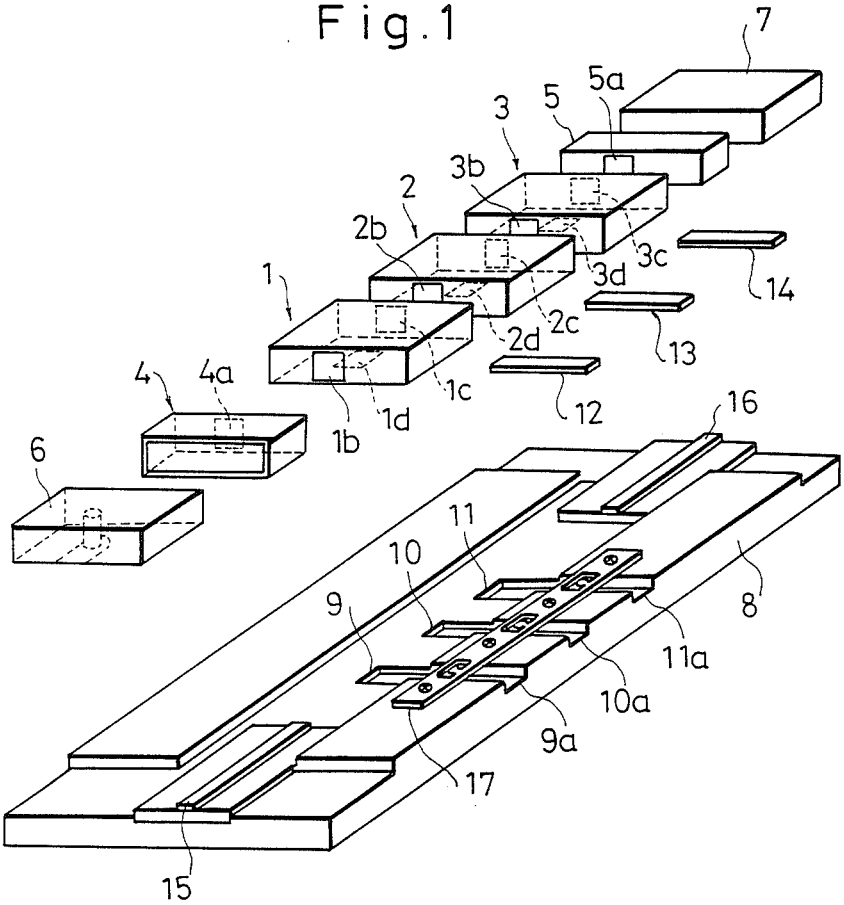
FIG. 1 is an exploded perspective view showing an embodiment of a waveguide filter according to the present invention.
Figure 2:
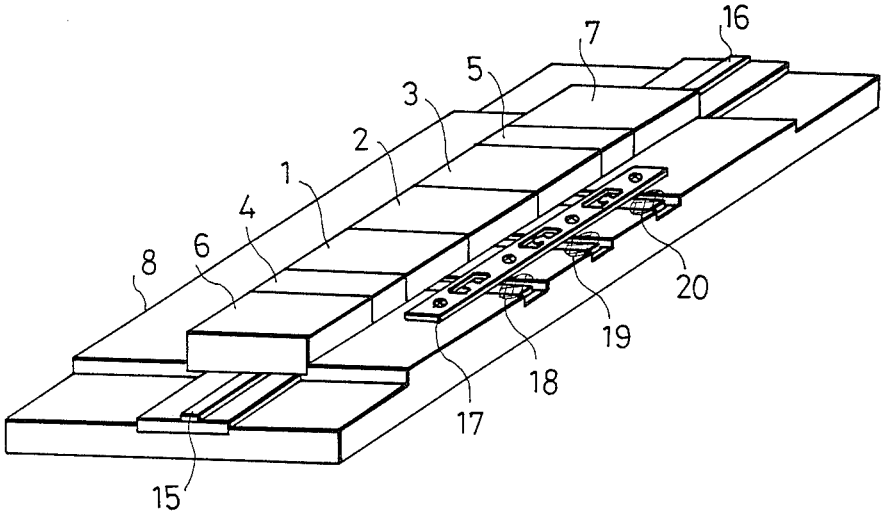
FIG. 2 is a built-up perspective view of FIG. 1.
Figure 3:
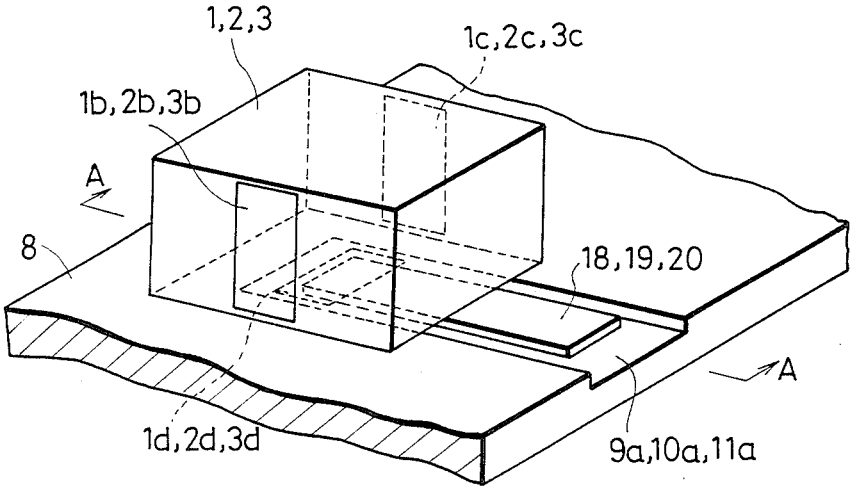
FIG. 3 is an enlarged perspective view of a waveguide resonator and an adjusting member shown in FIG. 1.
Figure 4:
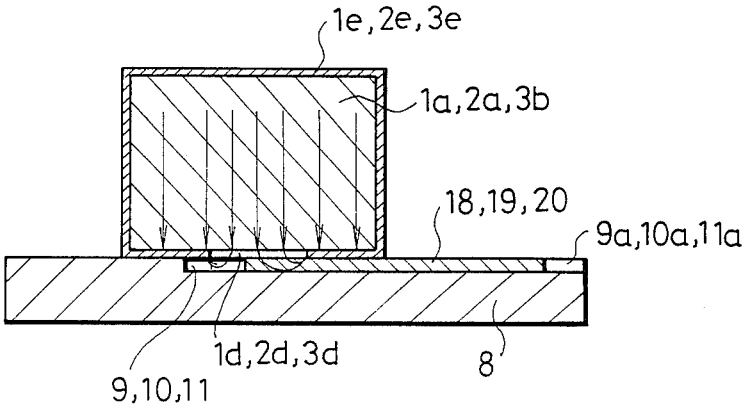
FIG. 4 is a sectional view taken along line A—A of FIG. 3.

Embodiments of the present invention will now be described in detail with reference to FIGS. 1 through 6.

In FIGS. 1 through 4, reference numerals 1 through 3 indicate waveguide resonators, each composed of a rectangular dielectric 1*a*, 2*a*, 3*a* having a length, width, height, and permittivity complying with the center frequency of a bandpass filter, on the surface of which a metal film 1*e*, 2*e*, 3*e* is provided except on the portions of induction windows 1*b*, 1*c*, 2*b*, 2*c*, 3*b*, 3*c* of its two sides mutually opposed in the longitudinal direction and on a no-electrode portion 1*d*, 2*d*, 3*d* of its bottom side. 4 and 5 indicate waveguides, each composed of a dielectric on the periphery of which a metal film is provided except on the portion of an induction window 4*a*, 5*a* of its one side arranged in the longitudinal direction and on the entire area of the side opposite to the above. 6 and 7 indicate waveguide-microstrip line mode converters. 8 indicates a metallic supporting base, in which there are formed concave portions 9 through 11 confronting the respective no-electrode portions 1*d*, 2*d*, and 3*d* of the bottom sides of the waveguide resonators 1 through 3 and grooves 9*a*, 10*a*, and 11*a* adjoining the former. 12 through 14 indicate adjusting members made of dielectric material, which are inserted in the grooves 9*a*, 10*a*, and 11*a* slidably and retractably with respect to the respective concave portions. 15 and 16 indicate microstrip lines, and 17 indicates a fixing plate which has claws for pushing resiliently the adjusting members 12 through 14.

By inserting the adjusting members 12 through 14 into the corresponding grooves 9 through 11 of the supporting base 8 and securing the fixing plate 17 on the supporting base 8 by means, for example, of machine screws, the adjusting members 12 through 14 are made to contact resiliently with the supporting base 8 and disposed thereon slidably. Then, one mode converter 6, waveguide 4, waveguide resonators 1 through 3, waveguide 5, and other mode converter 7 are arranged in this order on the supporting base 8, and soldered and secured thereto. Further, the waveguides 4 and 5 and the waveguide resonators 1 through 3 are secured mutually together through the liquid soldering or like process. Furthermore, the microstrip lines 15 and 16 and the mode converters 6 and 7 are connected adequately together.

In the configuration thus assembled, as the adjusting members 12 through 14 are slided, the no-electrode portions 1*d*, 2*d*, and 3*d* are covered by the adjusting members 12 through 14 to change their areas being covered, whereby the respective areas opened to the air inside the respective concave portions 9 through 11 are varied. Thus, the more the no-electrode portion 1*d*, 2*d*, 3*d* is covered by the adjusting member 12, 13, 14, the larger can the electric field travelling through the no-electrode portion 1*d*, 2*d*, 3*d* pass through the dielectric of the adjusting member 12, 13, 14 and reach up to the metal film 1*e*, 2*e*, 3*e*, to thereby achieve an equivalent effect to that resulting from an increase of permittivity and lower the center frequency. On the contrary, if the no-electrode portion 1*d*, 2*d*, 3*d* is opened widely, the resultant effect is equal to that resulting from a decrease of permittivity and the center frequency rises. Through the foregoing adjustment, the adjusting members 12 through 14 are positioned and secured completely to the supporting base 8 by means, for example, of epoxy resins 18 through 20.

Figure 5:
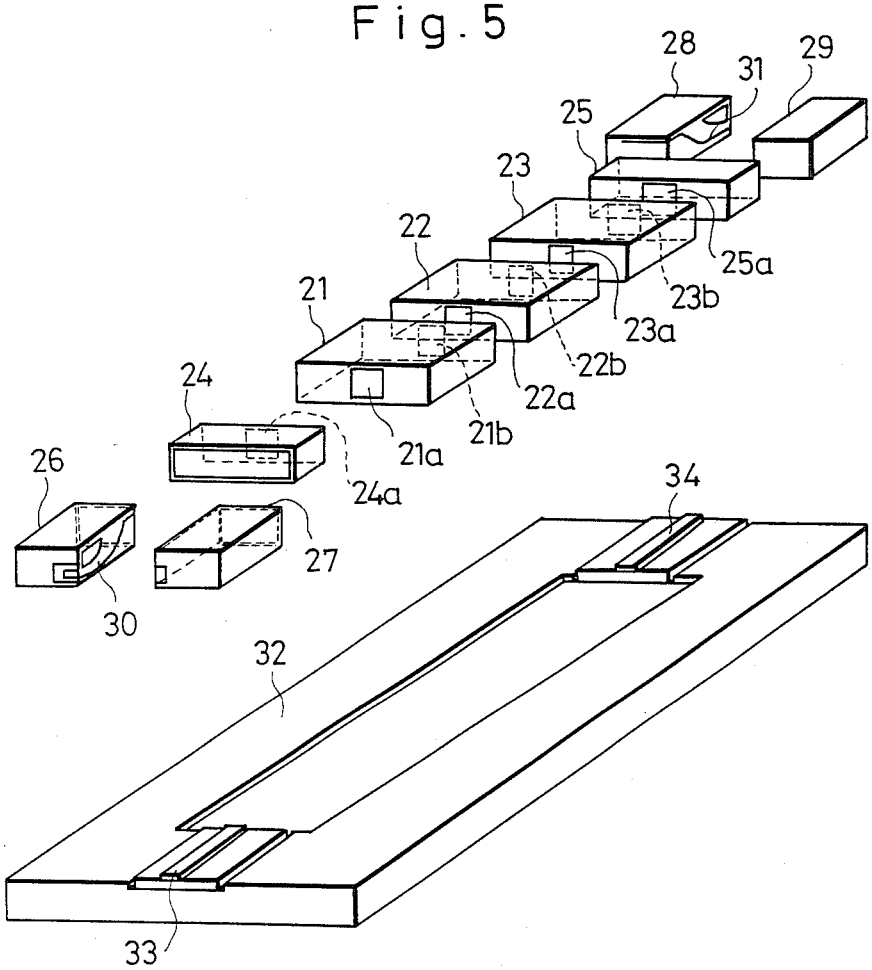
FIGS. 5 and 6 are fragmentary perspective views showing another embodiment of the waveguide filter according to the present invention.

Another embodiment of the present invention will now be described in detail with reference to FIGS. 5 and 6.

In FIGS. 5 and 6, 21 through 23 indicate waveguide resonators, each composed of a rectangular dielectric having a length, width, height, and permittivity complying with the center frequency of a bandpass filter, on the periphery of which a metal film is provided except on the portions of induction windows 21*a*, 21*b*, 22*a*, 22*b*; 23*a*, 23*b*; of its two sides mutually opposed in the longitudinal direction. 24 and 25 indicate waveguides, each composed of a rectangular dielectric on the periphery of which a metal film is provided except on the portion of an induction window 24*a*, 25*a*, of its one side arranged in the longitudinal direction and on the entire area of the side opposite to the above. 26, 27, 28 and 29 indicate mode converters, each composed of a dielectric on the surface of which a metal film is provided, with some ones having patterns 30, 31 formed adequately thereon for mode conversion between waveguide and microstrip line. 32 indicates a supporting base, and 33 and 34 indicate microstrip line circuits.

Two mode converters 26 and 27, waveguide 24, waveguide resonators 21 through 23, waveguide 25, and two other mode converters 28 and 29 are arranged in this order on the supporting base 32, and soldered and secured thereto. Further, the waveguides 24 and 25 and the waveguide resonators 21 through 23 are secured mutually together through the liquid soldering or like process. Furthermore, the microstrip lines 33 and 34 and the mode converters 26 through 29 are connected together by subjecting metal foils 35 to the thermocompression bonding process.

Figure 6:
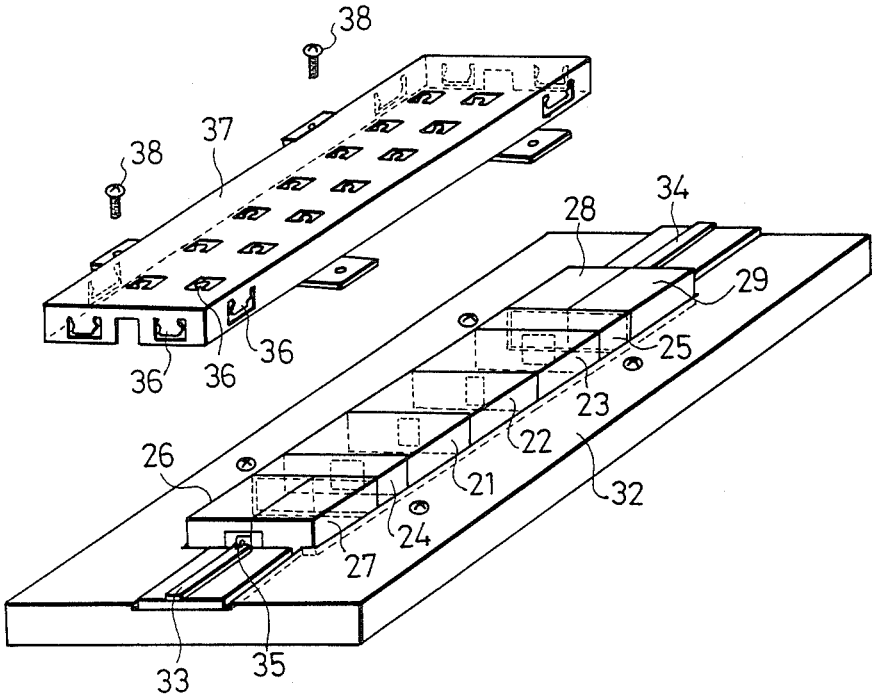
Figure 7:
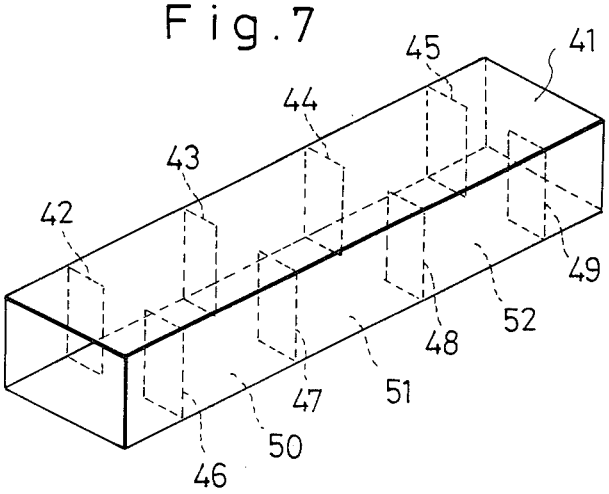
FIG. 7 is a perspective view showing the principle of the waveguide filter.
Figure 8:
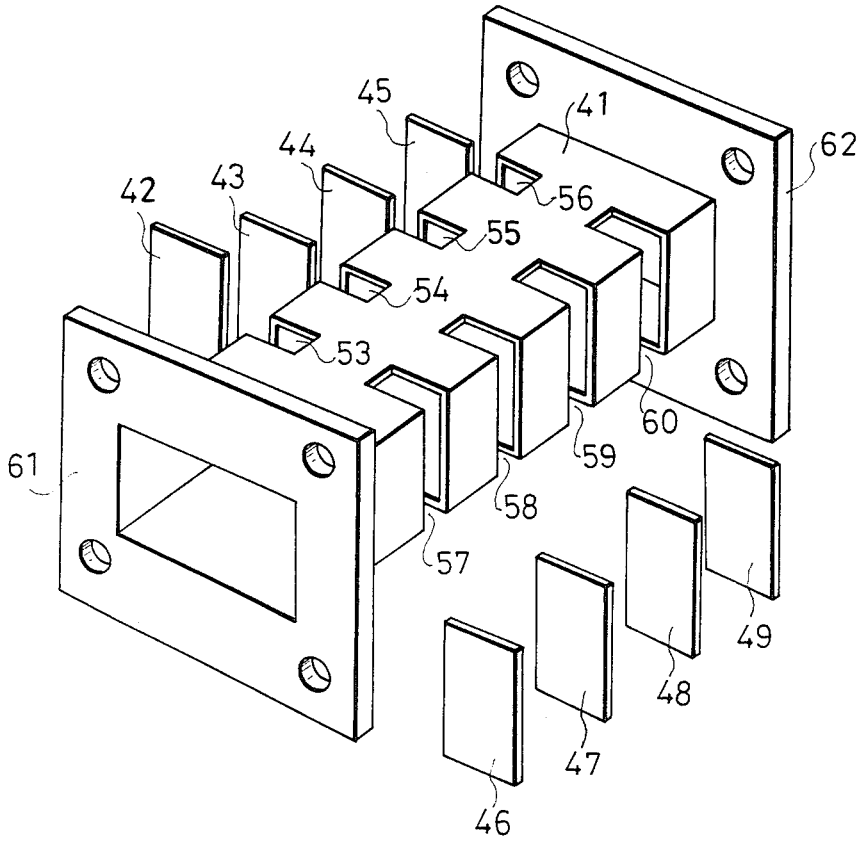
Fig. 8 PRIOR ART
FIG. 8 is an exploded perspective view showing an example of the conventional waveguide filter.
Figure 9:
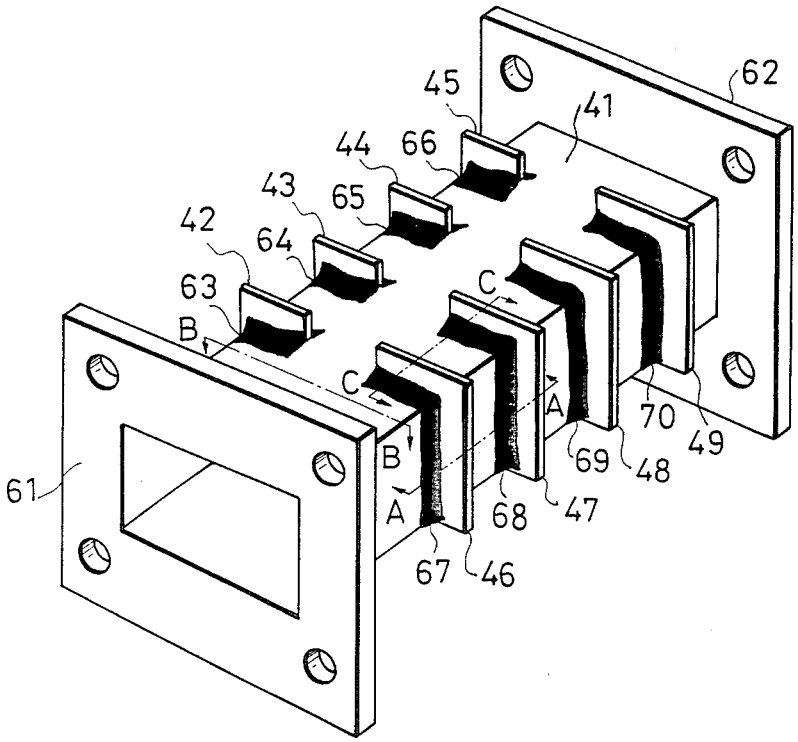
Fig. 9 PRIOR ART
FIG. 9 is a built-up perspective view of FIG. 8.
Figure 10:
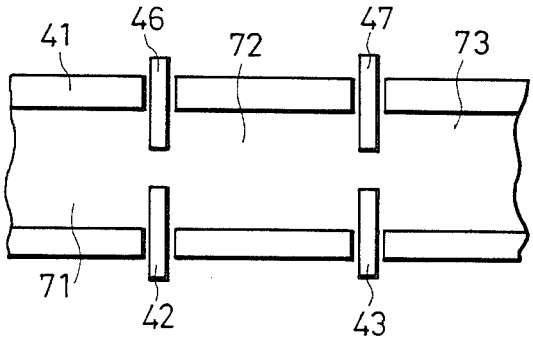
Fig.10 PRIOR ART
FIG. 10 is a sectional view taken along line A—A of FIG. 9.
Figure 11:
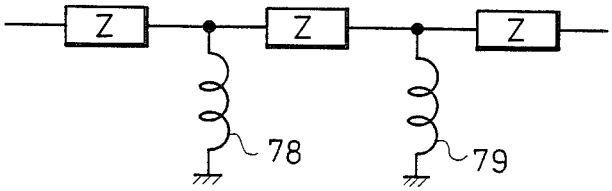
Fig.11 PRIOR ART
FIGS. 11 and 12 are equivalent circuit diagrams of FIG. 10.
Figure 12:
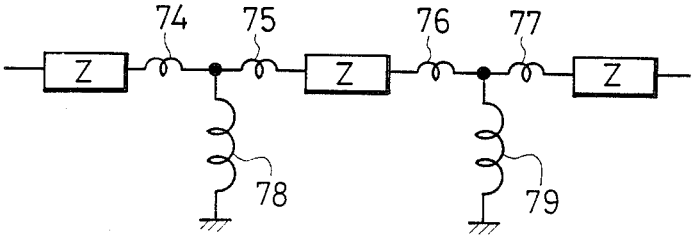
Fig.12 PRIOR ART
Figure 13:
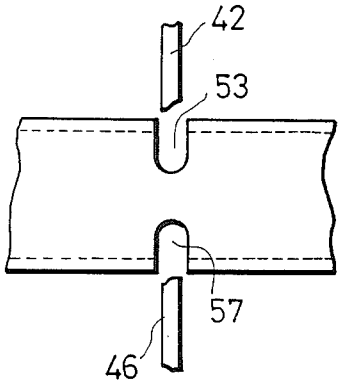
FIG. 13 is an enlarged sectional view showing inductor plates and slots.
Figure 14:
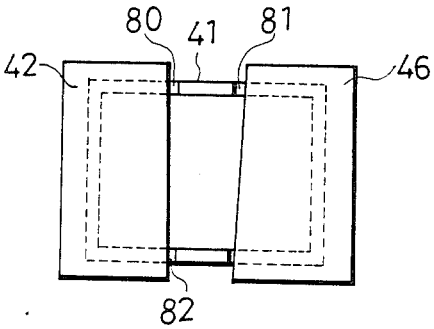
FIG. 14 is a sectional view taken along line B—B of FIG. 9.
Figure 15:
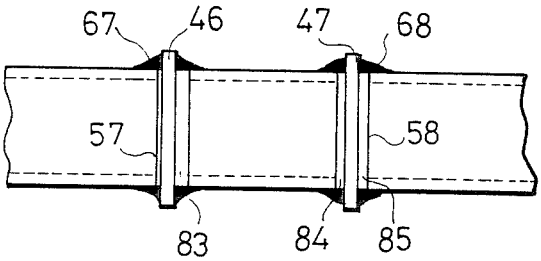
FIG. 15 is a sectional view taken along line C—C of FIG. 9.
Figure 16:
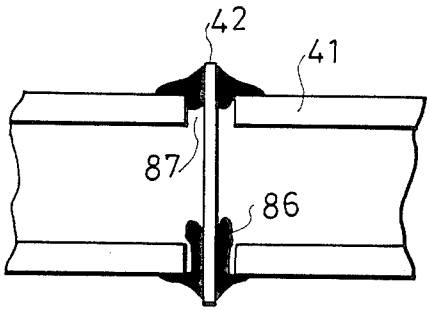
FIG. 16 is a sectional view showing the state of soldering performed to secure the inductor plate.
Figure 17:
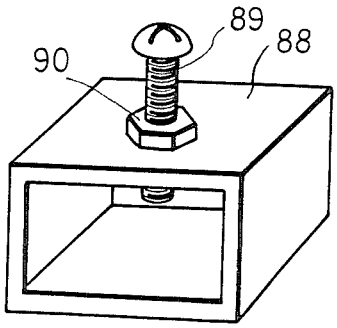
Fig.17 PRIOR ART
FIG. 17 is a perspective view of an adjusting circuit for adjusting the center frequency of the conventional waveguide circuit.

Then, as shown in FIG. 6, a cover formed with resilient claws 36, . . . , 36 is put on the mode converters 26 and 27, waveguide 24, waveguide resonators 21 through 23, waveguide 25, and other mode converters 28 and 29 arranged in this order on the supporting base 32, and is secured to the supporting base 32 by means of screws 38, . . . , 38. By means of the resiliency of the claws 36, . . . , 36, the mode converters 26 through 29, waveguides 24 and 25, and waveguide resonators 21 through 23 are fixed on the supporting base 32, and the waveguides 24 and 25 and the waveguide resonators 21 through 23 are made to contact tightly together. Because the waveguide filter of this embodiment is not subjected to the soldering process, the work of exchanging parts, such as the waveguide resonators 21 through 23, of the waveguide filter and the like work can be achieved simply.

As described above, in the waveguide filter according to the present invention, the waveguide resonator is fabricated by providing the metal film on th periphery of the rectangular dielectric thereof, and the metal film attached to the sides arranged in the longitudinal direction of the rectangular dielectric except to the portions of the induction windows is remarkably thin as compared with the conventional inductor plate and accurate in dimension in the longitudinal direction; thus, the center frequency does not deviate. Further, the induction window can be formed at a high degree of dimensional precision through etching or the like; thus, the passband width deviates little. Consequently, the center frequency and the passband width of the device functioning as the bandpass filter exhibit little variations and the range within which adjustment shold be performed is small; thus, it is possible to suppress correspondingly small the transmission loss of the adjusting mechanism, and because there is no connecting portin of metal in the surface current path of the waveguide resonator, the transmission loss is small.

Further, because the radio wave travels through the dielectric, the size of the waveguide filter can be miniaturized. For example, if the waveguide resonator is made by dielectric material having a relative permittivity of 9.6 and the center frequency is set to 12 GHz, the waveguide resonator of the waveguide filter of the present invention measures 6.1 mm width by 4.8 mm length, as compared with the conventional waveguide resonator measuring 19 mm width by 15 mm length in which the radio wave travels through the air. In the case of a 4 GHz band, the conventional device of 58 mm width by 40 length can be reduced to the dimensions of 19 mm width by 13 mm length. More, if the waveguide resonator is made by dielectric material having a relative permittivity of 100 in a 1.5 GHz band, the waveguide resonator of the waveguide filter of the present invention can be miniaturized to the dimensions of 8 mm width by 11 mm length, as compared with the conventional waveguide resonator measuring 82 mm width by 110 mm length.

Furthermore, according to the conventional waveguide filter, the metal making up the filter expands and contracts in response to a change of temperature so that the dimensions of the waveguide resonator are altered; thus, its center frequency involves a deviation. On the contrary, according to the waveguide filter of the present invention, by using dielectric material of the sort which shows little change in dimension not in proportion to a change of temperature there results in the distinguished effect that the deviation of the center frequency can be suppressed.

In addition, because the center frequency is adjusted by changing substantially the permittivity of the path of the electric field, the current path includes no convex portion and involves only a little transmission loss, unlike the conventional device. Still more, by making up the adjusting member for changing substantially the permittivity by dielectric material of large permittivity, an adjustable range can be made large. Incidentally, the no-electrode portion is surrounded by the supporting base, so that there exists no loss caused by radiation.

What is claimed is:

1. A waveguide filter comprising:

a plurality of separately formed waveguide resonators arranged in a series in a longitudinal direction of the filter, each of said waveguide resonators being composed of a solid dielectric block having a peripheral surface, a length aligned with the longitudinal direction of the filter, and a permittivity corresponding to a desired center bandpass frequency of the filter, and a metal film formed over the peripheral surface of the dielectric block except for two areas on mutually opposite sides of the block in the longitudinal direction which define two induction windows for the waveguide resonator, wherein adjacent waveguide resonators are arranged with their sides in the longitudinal direction in close contact with each other and their respective induction windows in registration with each other to form a transmission path for the filter.

2. A waveguide filter according to claim 1, including further a supporting base on which said waveguide resonators are secured, and a cover with claws for fixing said waveguide resonators to said supporting base by means of the resiliency of said claws.

3. A waveguide filter according to claim 2, including further microstrip line circuits provided on said supporting base, and mode converters and waveguides inserted between said microstrip line circuits and the ends of the series of said waveguide resonators.

4. A waveguide filter according to claim 1, further comprising a supporting base aligned in the longitudinal direction on which the waveguide resonators are secured and having a plurality of concave portions formed therein corresponding to the plurality of waveguide resonators, wherein the metal film formed on the peripheral surface of the dielectric block of each waveguide resonator has an opening formed on a bottom side thereof which is disposed in confronting relation to a respective one of the concave portions of the supporting base, and a corresponding plurality of adjusting members made of dielectric material each of which is disposed slidably and retractably in a respective one of the concave portions in front of the opening in the metal film formed on the bottom side of the respective waveguide resonator so as to adjustably vary an area of the opening exposed by the adjusting member.

5. A waveguide filter according to claim 4, including further a fixing plate with claws for pushing resiliently said adjusting members in said concave portions.

6. A waveguide filter according to claim 5, including further microstrip lines provided on said supporting base, and mode converters and waveguides inserted between said microstrip lines and opposite ends of the series of said waveguide resonators.

* * * * *